US007603794B2

(12) United States Patent
Oh

(10) Patent No.: US 7,603,794 B2
(45) Date of Patent: Oct. 20, 2009

(54) REAR BALANCE WALKING SHOES

(76) Inventor: Dong Jae Oh, Saehan Sensivill 106-2002, 1228, U-dong, Haeundae-gu, Busan 612-022 (KR)

( * ) Notice: Subject to any disclaimer, the term of this patent is extended or adjusted under 35 U.S.C. 154(b) by 285 days.

(21) Appl. No.: 11/708,967

(22) Filed: Feb. 21, 2007

(65) Prior Publication Data

US 2007/0180732 A1 Aug. 9, 2007

Related U.S. Application Data

(63) Continuation of application No. PCT/KR2005/004382, filed on Dec. 20, 2005.

(30) Foreign Application Priority Data

Dec. 20, 2004 (KR) ..... 10-2004-0108870

(51) Int. Cl.
*A43B 13/00* (2006.01)

(52) U.S. Cl. ..... 36/25 R; 36/31

(58) Field of Classification Search ..... 36/25 R, 36/31, 30 R, 33, 142
See application file for complete search history.

(56) References Cited

U.S. PATENT DOCUMENTS

| | | | | | |
|---|---|---|---|---|---|
| 1,486,630 | A | * | 3/1924 | Burnett | 36/11.5 |
| 4,041,619 | A | * | 8/1977 | Sapper | 36/25 R |
| 4,262,433 | A | * | 4/1981 | Hagg et al. | 36/25 R |
| 4,439,937 | A | * | 4/1984 | Daswick | 36/107 |
| 4,542,598 | A | * | 9/1985 | Misevich et al. | 36/114 |
| 4,722,144 | A | * | 2/1988 | Beerli | 36/117.4 |
| 4,854,057 | A | * | 8/1989 | Misevich et al. | 36/114 |
| 5,592,757 | A | * | 1/1997 | Jackinsky | 36/114 |
| 5,727,335 | A | * | 3/1998 | Kousaka et al. | 36/31 |
| 5,826,351 | A | * | 10/1998 | Tsuji | 36/25 R |
| 5,974,699 | A | * | 11/1999 | Park | 36/103 |
| 6,212,795 | B1 | * | 4/2001 | Nakabe et al. | 36/25 R |
| 6,260,289 | B1 | * | 7/2001 | Tsuji | 36/103 |
| 6,393,735 | B1 | * | 5/2002 | Berggren | 36/129 |
| 2002/0017038 | A1 | * | 2/2002 | Umezawa | 36/31 |
| 2002/0157279 | A1 | * | 10/2002 | Matsuura et al. | 36/25 R |
| 2005/0022425 | A1 | * | 2/2005 | Brown | 36/30 R |
| 2006/0117603 | A1 | * | 6/2006 | Park | 36/25 R |

FOREIGN PATENT DOCUMENTS

| | | | |
|---|---|---|---|
| EP | 0860121 | A2 | 8/1998 |
| WO | WO 8200245 | A1 * | 2/1982 |
| WO | 01/15560 | A1 | 2/2008 |

OTHER PUBLICATIONS

International Search Report (PCT/KR2005/004382), Mar. 25, 2006, 2 pages.

* cited by examiner

*Primary Examiner*—Marie Patterson
(74) *Attorney, Agent, or Firm*—Park & Associates IP Law LLC

(57) ABSTRACT

The present invention relates to a rear balance walking shoe having a sole in which double earth axes are formed on the sole at a rear side with respect to the middle of the sole, and the heel and the toe of the sole are elevated from respective double earth axes and perform see-saw motions at the double earth axes serving as application points. By wearing these shoes, the center of gravity of a wearer's body is inclined backward, resulting in reduction of obesity by activating muscles of the trunk. Still further, since a wearer feels comfortable even if the wearer wears the shoes for a long time and can reduce impact transferred to the wearer's feet, an exercise effect is enhanced.

6 Claims, 12 Drawing Sheets

FILE ID: ANONYMOUS 5.0.0x 13 NOV 04 10:29

Inje University Hospital Dept. of Rehabilitation

FILE ID: ANONYMOUS 5.0.0x 13 NOV 04 10:43

Inje University Hospital Dept. of Rehabilitation

REAR BALANCE WALKING SHOES

REFERENCE TO RELATED APPLICATIONS

This is a continuation of pending International Patent Application PCT/KR2005/004382 filed on Dec. 20, 2005, which designates the United States and claims priority of Korean Patent Application No. 10-2004-0108870 filed on Dec. 20, 2004.

FIELD OF THE INVENTION

The present invention relates to functional footwear, and more particularly to a rear balance walking shoe in which two ground-contact regions or protrusions are formed on a sole to relatively rear sides from the middle of the sole, and a heel portion and a toe portion of the sole are elevated relative to the two ground-contact protrusions which serve as application points, so that the heel and toe portions perform see-saw motions using the ground-contact protrusions as application points.

BACKGROUND OF THE INVENTION

Recently, it has been reported that 35% of people in cities are overweight due to increased fast food intake and lack of exercise. This phenomenon is spreading all over the world and has become a primary cause of cancers and adult diseases.

More over, the National Obesity Forum in British reported that 80% of diabetes cases, 50% of high blood pressure cases, and 25% of cancers associated with obesity would be reduced if obesity were eliminated the world. That is, obesity is become recognized as a serious problem for modern societies.

In order to solve this obesity problem, diets and eating habits must be changed and regular exercise is necessary. However, modern people have little time to do regular exercise, and it takes a long time to do aerobic exercise to get rid of obesity.

In order to solve this problem, developed are a variety of functional shoes that provide exercise effects to a user when the user simply walks, wearing the shoes without particularly devoting and or setting aside time.

As shown in FIG. 1, there are two types of conventional functional shoes. In FIG. 1, (a) is a ball-support- type shoe and (b) is an unstable ball-support-type shoe.

In the ball-support-type shoe, a sole comprises a rear portion which is low and a front portion which is high and flat. In the conventional ball-support-type shoe, a wearer's toe and ball are elevated relative to the heel when the shoe is worn by the wearer. Accordingly, the wearer will tend to stand with the body inclined slightly forward so as to maintain balance.

FIG. 2 illustrates contraction and relaxation states of muscles when the ball- support-type shoe is put on. Referring to FIG. 2, muscles of the shin and front muscles of the thigh are contracted and a scapular muscle is severely contracted.

The ball-support-type shoe has the following disadvantages. First, if a wearer wears the ball-support-type shoe for a long time, since the shin muscles, the front thigh muscles, and the scapular muscles are continuously contracted, lower body muscles are strengthened, but abdominal obesity which is the primary cause of adult disease, is not eliminated.

Second, since the trunk of a wearer is inclined forward and. thereby the scapular muscle is continuously taut, gastrointestinal disorders are caused.

Third, if the walker walks wearing the ball-support-type shoes, since the wearer walks with elevated heels giving strength to the toes, the wearer feels uneasy. Further, obese walkers and old-aged walkers may easily fall down.

Fourth, since walking strides of the wearer are not natural, the wearer is not willing to wear these shoes because of their conspicuous appearance. Accordingly, the shoes do not give good exercise effects to the wearer of the shoes.

On the other hand, the unstable ball-support-type shoe causes a walker to stand more stably compared to the ball-type-support shoe, but the walker still feels uneasy while walking with the shoes and standing inclined forwards. Accordingly, the unstable ball-support-type shoe has the same disadvantages as the ball-support-type shoe.

SUMMARY OF THE INVENTION

Accordingly, the present invention has been made keeping in mind the above problems occurring in the prior art and to solve the problems, and an object of the present invention is to provide a rear balance walking-shoe in which two ground-contact protrusions are formed on a sole so as to facilitate a walker to stand inclined backward.

Another object of the present invention is to provide a rear balance walking-shoe capable of reducing impact by designing curvatures of the sole of the shoe to accommodate curvatures of motions of body parts of the wearer.

In order to achieve the above objects, according to one aspect of the present invention, there is provided a rear balance walking-shoe comprising a sole in which double ground-contact protrusions are formed on the sole toward the rear side from the middle of the sole, and a heel and a toe of the sole are elevated upward from the respective ground-contact protrusions to perform seesaw-like motions with the double ground-contact protrusions serving as application points for the motions.

The double ground-contact protrusions comprise a first ground-contact protrusion positioned at a region between a point of 50% and a point of 55% measured from the front end of the sole, and a second ground-contact protrusion positioned at a region between a point of 65% and a point of 75% measured from the front end of the sole.

The sole has curvatures in a rear portion, a middle portion and a front portion, and the curvatures are formed to accommodate curvatures of motions of an ankle, a knee and a thigh.

The radius of the curvature of the rear portion of the sole is about 80 to 100 mm, the radius of the curvature of the middle portion of the sole is about 90 to 110 mm, and the radius of the curvature of the front portion of the sole is about 400 to 500 mm.

The rear balance walking shoe further comprises a rigid auxiliary sole disposed on the sole.

The rigid auxiliary sole has a flexible strength in the range of 70 to 120 kgf.

An inner portion of the sole is thinner than outer portions of the sole.

The rear balance walking shoe according to the present invention has the advantages of (a) reducing obesity by activating muscles of the trunk of a wearer's body and (b) improving a body line, i.e. a waist line and a hip line, by inclining the center of gravity of a wearer's body backward with double earth axes formed on the sole of the shoe.

Since the sole of the shoe has curvatures designed to accommodate curvatures of motions of the wearer's body, little impact is transferred to the wearer's feet, so that the wearer feels stability and comfort for a long time, and the exercise effect is enhanced.

Further, since a sense and an ability of rear balance are naturally experienced, and posture and walking strides are corrected, aging is prevented and the musculoskeletal system is improved.

BRIEF DESCRIPTION OF THE DRAWINGS

The above aspect and other features of the present invention will become more apparent by describing in detail exemplary embodiments thereof with reference to the attached drawing figures, wherein.

DETAILED DESCRIPTION OF THE INVENTION

Hereafter, embodiments of the present invention will be described with reference to the accompanying drawings.

Figure 1:
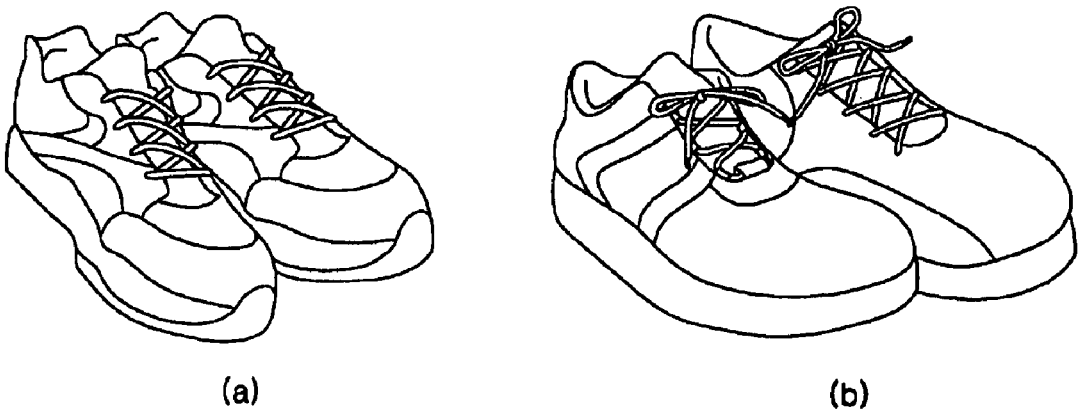
FIG. 1 illustrates perspective views of conventional diet shoes, in which (a) illustrates a ball-support-type shoe and (b) illustrates an unstable ball-support-type shoe.
Figure 2:
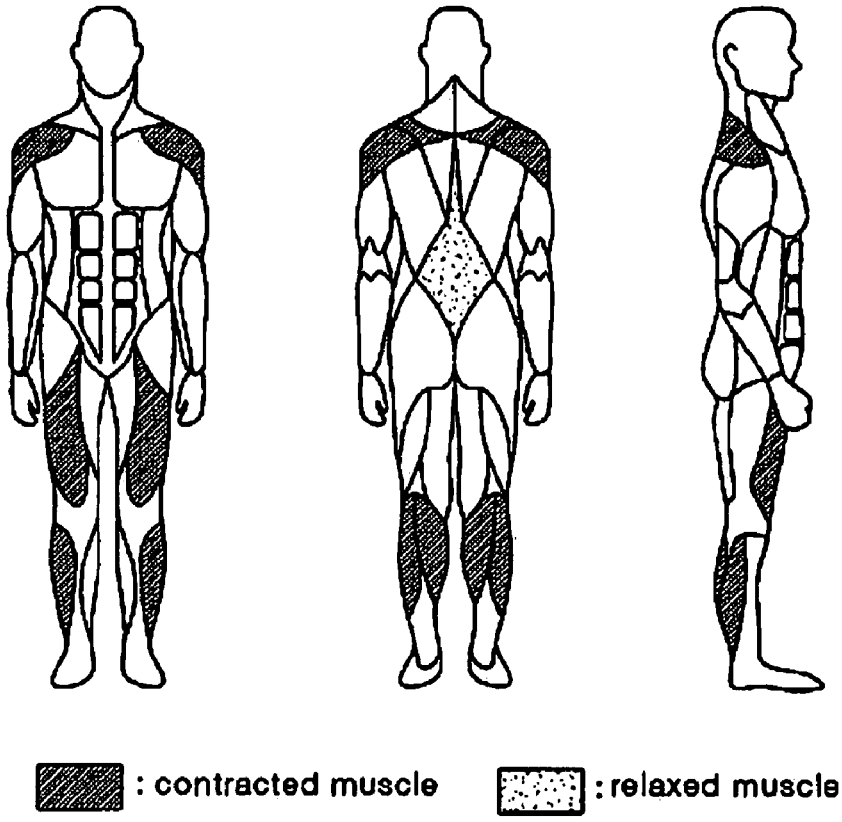
FIG. 2 illustrates the degree of contraction and relaxation of muscles of the human body when a walker wears the shoes shown in FIG. 1.
Figure 3:
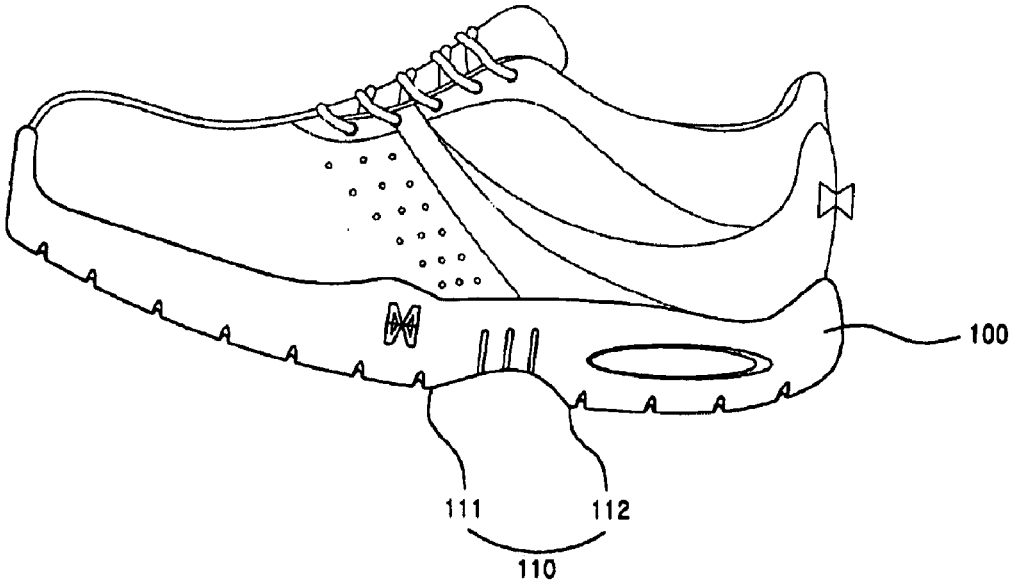
FIG. 3 is a perspective view of a rear balance walking shoe according to one embodiment of the present invention.

Referring to FIG. 3, a rear balance walking shoe according to the present invention has a sole 100 with dual ground-contact protrusions 110. The dual ground-contact protrusions 110 are disposed at a rear portion of the sole 100.

The front portion and the rear portion of the sole 100, extending from the dual axes 110 are elevated towards both respective ends of the sole 100, so that the toe portion and the heel portion of the shoe perform a see-saw motion while the dual ground-contact protrusions 110 act as points of application for the motion.

Accordingly, a wearer can stand well-balanced due to the dual ground-contact protrusions 110 even if a wearer's body is swayed back and forth. Further, since the dual ground-contact protrusions 110 are slightly biased towards the rear of the sole 100, a wearer's body stands naturally inclined backward when the wearer stands still, relaxing his or her body after the wearer's body has moved backwards and forwards. At this time, since the wearer's body applies force forward to maintain balance as a reaction, rearward balancing is improved.

Figure 6:
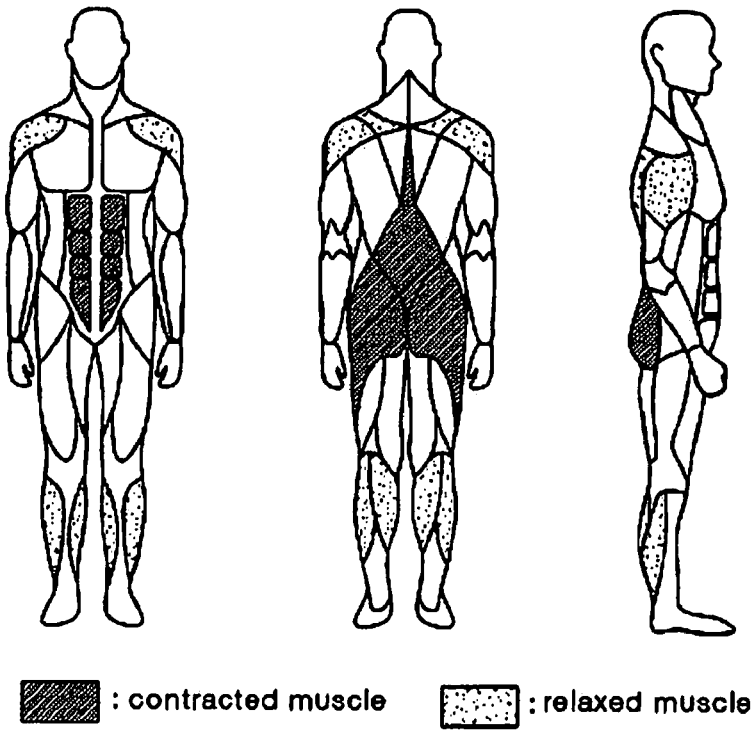
FIG. 6 illustrates the degree of contraction of muscles when a walker wears the rear balance walking shoes according to the present invention.

FIG. 6 illustrates states in which muscles of the wearer's body are contracted and relaxed, showing the results of tests of muscle contraction and relaxation of the wearer's body when the walker wears the shoe of the invention, obtained through an electromyography.

As shown in the drawing, scapular muscles and lower body part muscles are relaxed, and muscles of the torso are contracted. In this state, if the wearer repeats walking strides, wearing the rear balance walking shoes, the muscles are activated to a state facilitating reduction of fat in the wearer's body.

Hereinafter, the position of the dual ground-contact protrusions 110 is described below in detail. Seen from the anatomy of the foot, a balancing center point of a foot is located between an anklebone and the toes. General sneakers or shoes are designed such that the point acts as the central axis so that the center of gravity of a wearer's body is not inclined. However, according to the embodiment of the present invention, the double ground-contact protrusions 110 are formed to the rear side from the central axis of the shoes. Accordingly, the second ground-contact protrusion 112 reduces uneasiness caused in the case in which a shoe has only a first ground-contact protrusion 111, thereby ensuring stability of the shoes. This motivates the user to wear the shoes for an extended period of time, resulting in an increased amount of exercise.

If the first earth axis 111 of the double ground-contact protrusions is located at a forwarder position on the sole, that is, the first ground-contact protrusion 111 is located between the tip of the top and the middle of the sole (50% of the length of the sole), the center of gravity of the wearer's body moves forward. On the other hand, if the first ground-contact protrusion 111 is located at the rearer portion of the sole, between a point of 55% of the length of the sole and the heel of the sole, the center of gravity of the wearer's body moves backward. In these cases, the walker feels uneasy, so that the shoes cannot effectively serve as walking shoes. Further, as the second ground-contact protrusion 112 of the double ground-contact protrusions 110 becomes farther from the toe of the sole and closer to the heel of the sole, particularly in the range from a point of 75% of the length of the sole toward the heel of the sole, the ground-contact area of the shoe becomes larger. Accordingly, the front portion and the rear portion of the sole cannot effectively perform a see-saw motion at the double ground-contact protrusions 110.

Accordingly, as shown in FIG. 3, the rear balance walking shoe according to the present invention is designed such that the first ground-contact protrusion 111 is positioned in a portion of the sole displaced from a point of 50% of the length of the sole from the toe end to a point of 55% of the length of the sole from the toe end, and the second ground-contact protrusion 112 is positioned in a portion of the sole, displaced from a point of 65% to a point of 70% of the length of the sole from the toe end.

Hereinafter, surface curvatures of the front portion and the rear portion of the sole will be described.

As described above, the front portion and the rear portion of the sole are elevated from the ground-contact protrusions 110 to the toe and the heel of the sole, respectively. Thanks to this structure, the sole performs see-saw motions by using the second ground-contact protrusion 112 as a point of application, so that the center of gravity repeatedly moves forwards and backwards. At this time, since the ground-contact protrusions 110 is formed in the rear portion of the sole, the center of gravity of the wearer's body tends to be inclined backward.

In this instance, curvatures of the rear portion, the middle portion, and the front portion of the sole 100 are designed to accommodate curvatures of motions of an ankle, a knee, and a thigh, respectively.

Generally, when people walk, the ankle, knee, and pelvis pivot slightly. When people walk such that the ankle, knee and pelvis pivot with adequate curvatures, the feet and joints of the ankle, knee and pelvis are not forcibly moved, and little impact is transferred thereto. Accordingly, walking posture can be corrected.

That is, in the rear balance walking shoe according to the present invention, since the curvatures of the sole 100 are designed to accommodate curvatures of motions of the ankle, knee and thigh, which are formed when people walk naturally, the shoe makes parts of a wearer's body pivot naturally, thereby preventing too much impact from being transferred to joints of the wearer's body and correcting wearer's posture.

According to reports and studies which have been made so far, in the case of Korean men with height in the range of 160 to 180 cm, the average length from the sole of the foot to the ankle joint, the average length from the sole of the foot to the knee joint, and the average length from the sole of the foot to the thigh joint are 6 cm, 45 cm and 90 cm, respectively.

The curvature of the sole 100 of the rear balance walking shoe according to the present invention reflect the motion trajectory of the sole of the foot which is determined by the radius of the pivot of each joint of each body part relating to the walking stride of the wearer and the combination of the radiuses of the joints.

The thickness of the sole 100 needed to absorb impact, compression of the sole 100, caused due to the weight of the wearer's body, deformation of the shape of the sole 100 according to changes in the earth surface while walking, and maintenance the of shape of the sole 100 with the aid of a rigid auxiliary sole 200, which will be described later, are considered in designing the rear balance walking shoe according to the present invention.

As a result, curvatures of the rear portion, the middle portion and the front portion of the sole 100, formed while a wearer walks, correspond to motion curvatures of the wearer's ankle, knee and thigh joints.

In more detail, in the sole 100 of the rear balance walking shoe according to the present invention, the curvature of the rear portion of the sole 100 has a radius of about 80 to 100 mm, the curvature of the middle portion of the sole has a radius of about 90 to 110 mm, and the curvature of the front portion of the sole has a radius of about 400 to 500 mm.

Preferably, in the sole 100 of the rear balance walking shoe according to the present invention, an inner portion of the sole 100 in the width direction of the sole is thinner than outer edge portions of the sole 100.

When people walk naturally with correct posture, the heel of the foot comes into contact with the earth first, then outer edges of the sole of the foot come into contact with the earth from the heel to the toe, and then the toe of the foot finally comes into contact with the earth. Then, the big toe pushes the earth backward, so that the wearer can advance forward.

According to the present invention, since the sole 100 of the shoe has an inner portion that is thinner than the outer portions, the shoe causes precise contact and rebound between the earth and the sole of the foot (from the heel, by way of the outer portions of the middle portion of the sole of the foot, to the toe of the foot). Accordingly, even if the wearer walks for a long time, little impact is applied to the foot when the sole of the foot touches earth, and damage is not caused to the foot or joints, so that the wearer can wear the shoe, feeling comfortable and easy, for a long time. Further, since the shoe induces good walking strides, the posture of the wearer of the shoes is corrected.

The rear balance walking shoe preferably may further comprise a rigid auxiliary sole 200 disposed on the sole 100, depending on the material of the sole 100, or under the insole of the shoe.

The rigid auxiliary sole 200 is provided to prevent the front portion and the rear portion of the sole 100 from becoming thinner by being compressed due to the weight of the wearer, and the double earth axes 110 from being worn quickly as the front portion and the rear portion of the sole 100 are elevated from the double earth axes 110 and load is concentrated on the double earth axes 110.

Accordingly, the rigid auxiliary sole 200 is formed of a material having a predetermined rigidity (flexural strength of 70 to 120 kgf, so that the structure of the sole 100 of the shoe is not deformed by the load of the body when the wearer stands still or walks.

Figure 4:
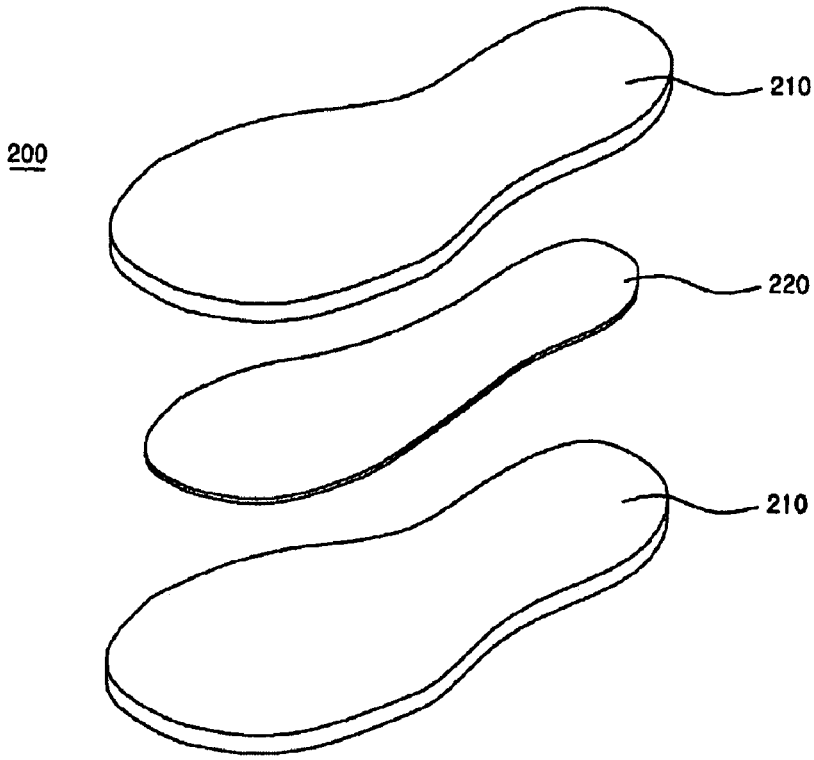
FIG. 4 illustrates perspective views of auxiliary soles of the rear balance walking shoe according to the one embodiment of the present invention.

Referring to FIG. 4, the rigid auxiliary sole 200 has a structure corresponding to the structure of the sole 100 and is disposed on the sole 100. The rigid auxiliary sole 200 is preferably formed of a layered structure in which a stainless steel plate 220 is interposed between plastic plates 210 (lasting boards). Alternatively, the rigid auxiliary sole 200 can be made of a single material having rigidity and durability, such as carbon, glass fiber-reinforced plastic, or nylon, or a combination thereof.

Accordingly, even though impact is continuously applied to the sole 100 while a wearer wears the shoe for a long time, the structure of the sole 100 is not deformed but is maintained, thereby giving stability and exercise effects to the wearer.

Hereinafter, the operation of the present invention will be described.

When a wearer stands still while the wearer wears the rear balance walking shoes according to the present invention, the wearer's body oscillates forwards and backwards at the double earth axes 110 serving as application points. While the body oscillates, since the double earth axes 110 are formed in a rear portion of the sole of the shoe, the center of gravity is inclined backwards and the wearer's body is inclined backwards.

Due to this reaction of force for preventing the wearer's body from being inclined backward, the wearer exerts the strength through the wearer's body. At this time, muscles are contracted and relaxed to the states shown in FIG. 6, which illustrates states of muscles measured by a diagnostic electromyograph. Referring to FIG. 6, scapular muscles and lower body muscles are relaxed, but muscles of the trunk of the body, such as hip muscles, waist muscles and abdominal muscles, are contracted. These states are not observed when a walker wears shoes that incline the center of gravity of the body is inclined forwards.

FIGS. 7 to 14 illustrate movements of muscles, that is, contraction and relaxation of muscles, as measured by a diagnostic electromyograph. In the graphs, the amplitude of variation represents the degree of instability, i.e. tensity.

The tibialis anterior is a muscle disposed in front of the fibula and used to lift the toes. The gastrocnemius is general muscles of the fibula. The peroneus longus are muscles disposed opposite the tibialis anterior, the erector spinae are muscles of the waist, the rectus abdominis are muscles of the abdomen, and the trapezius is a muscle disposed between the neck and the shoulder.

Figure 7:
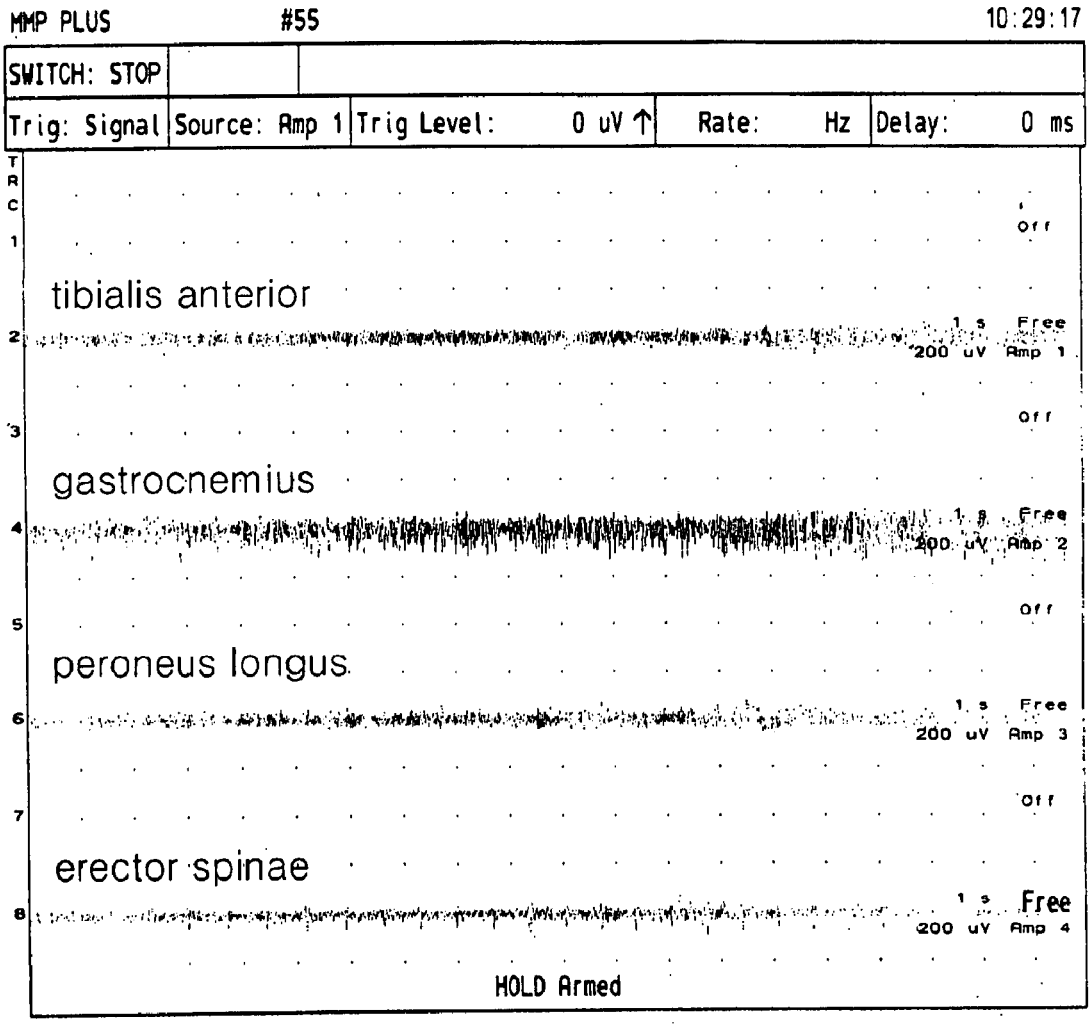
FIGS. 7 to 14 illustrate electromyograms measured while a walker wears the rear balance walking shoes according to the embodiment of the present invention.
Figure 8:
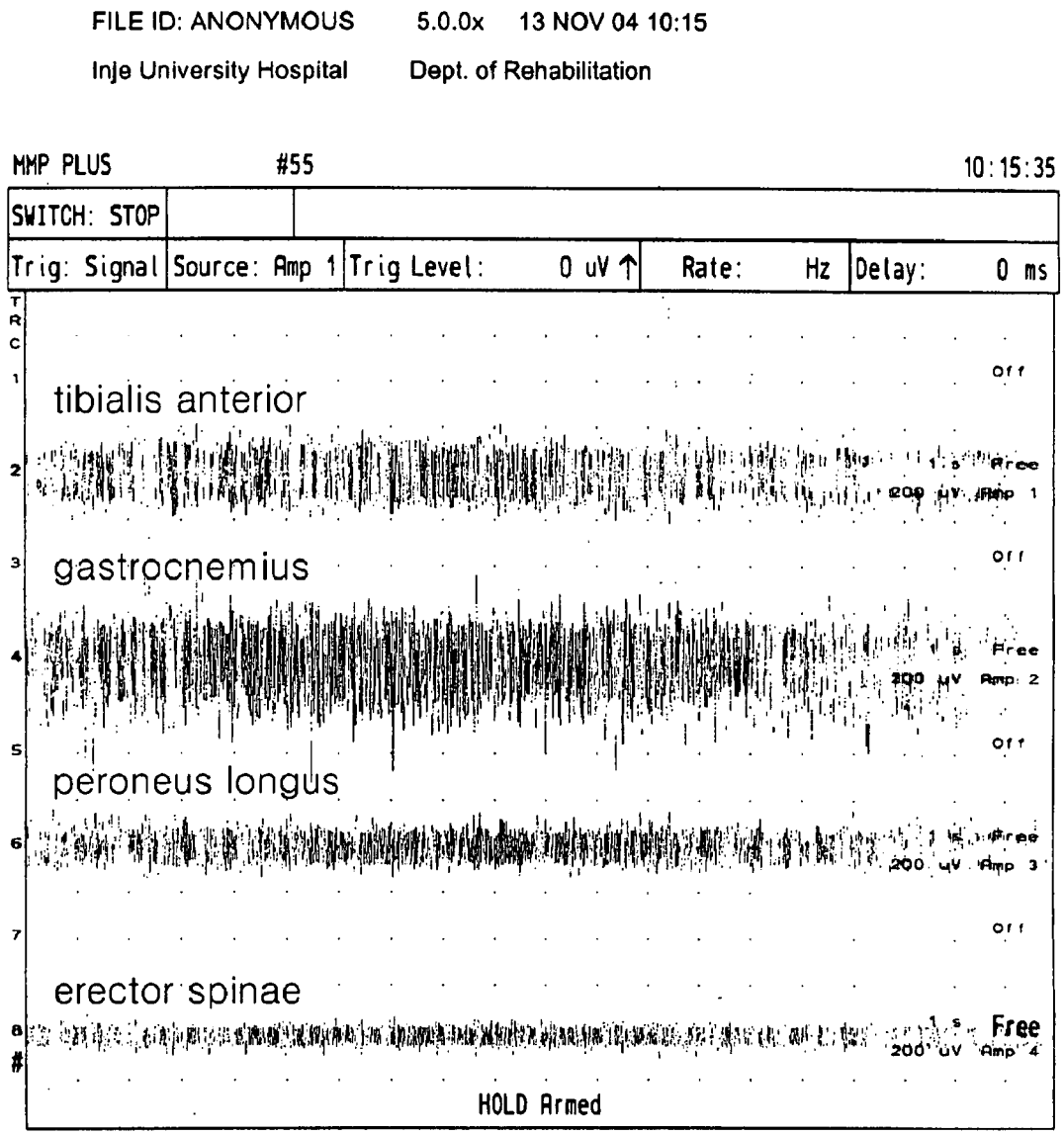
Figure 9:
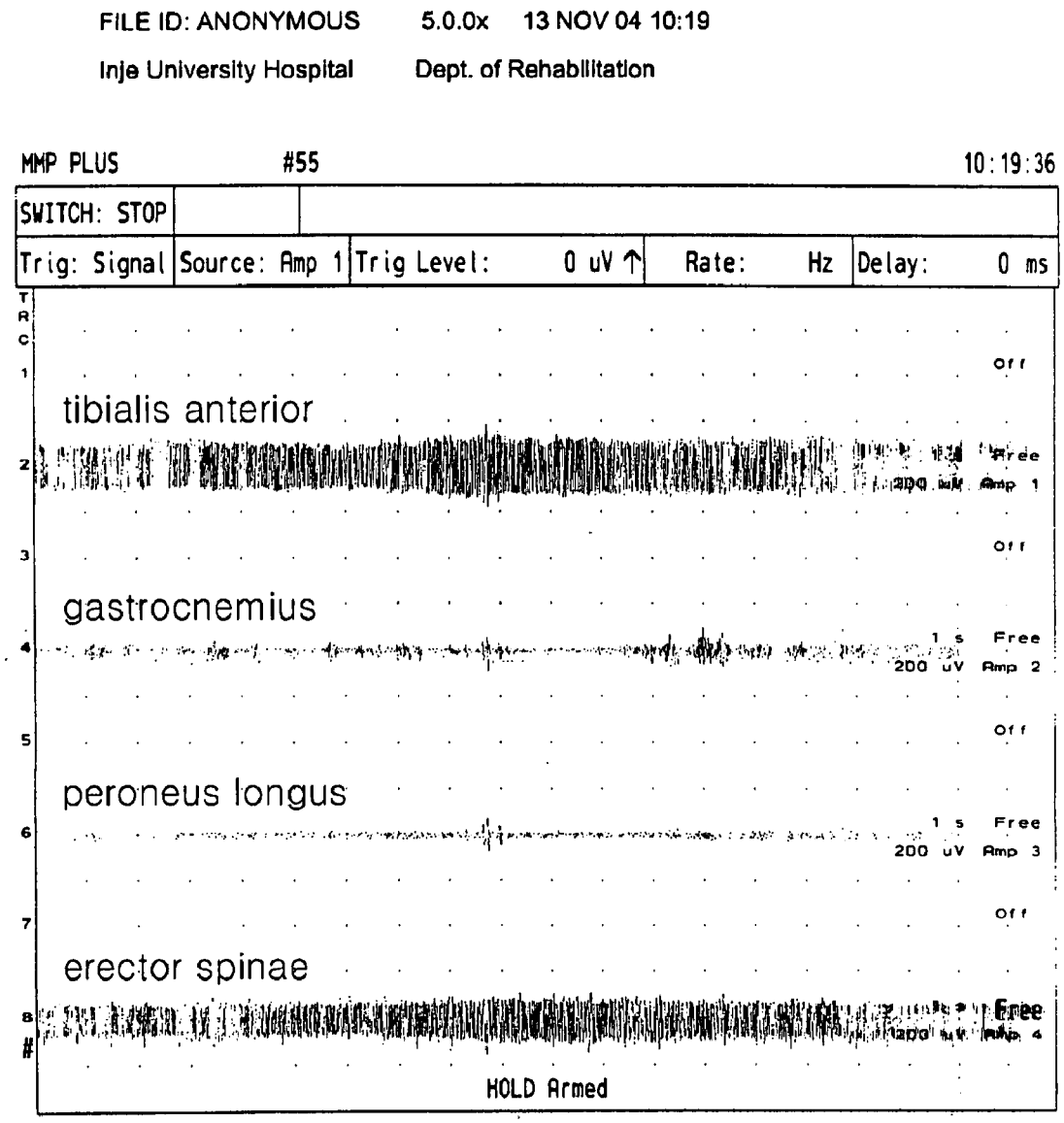
Figure 10:
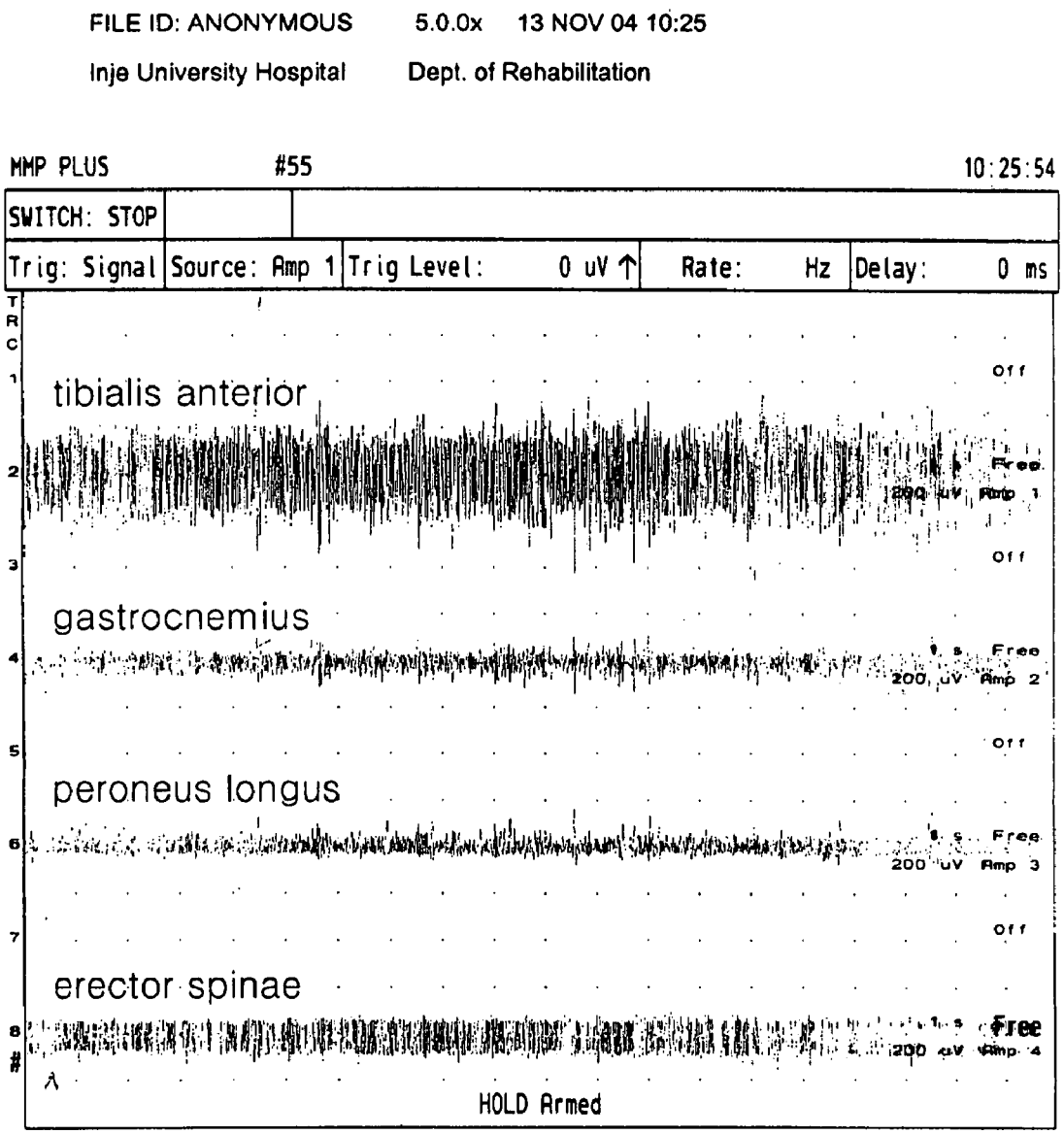
Figure 11:
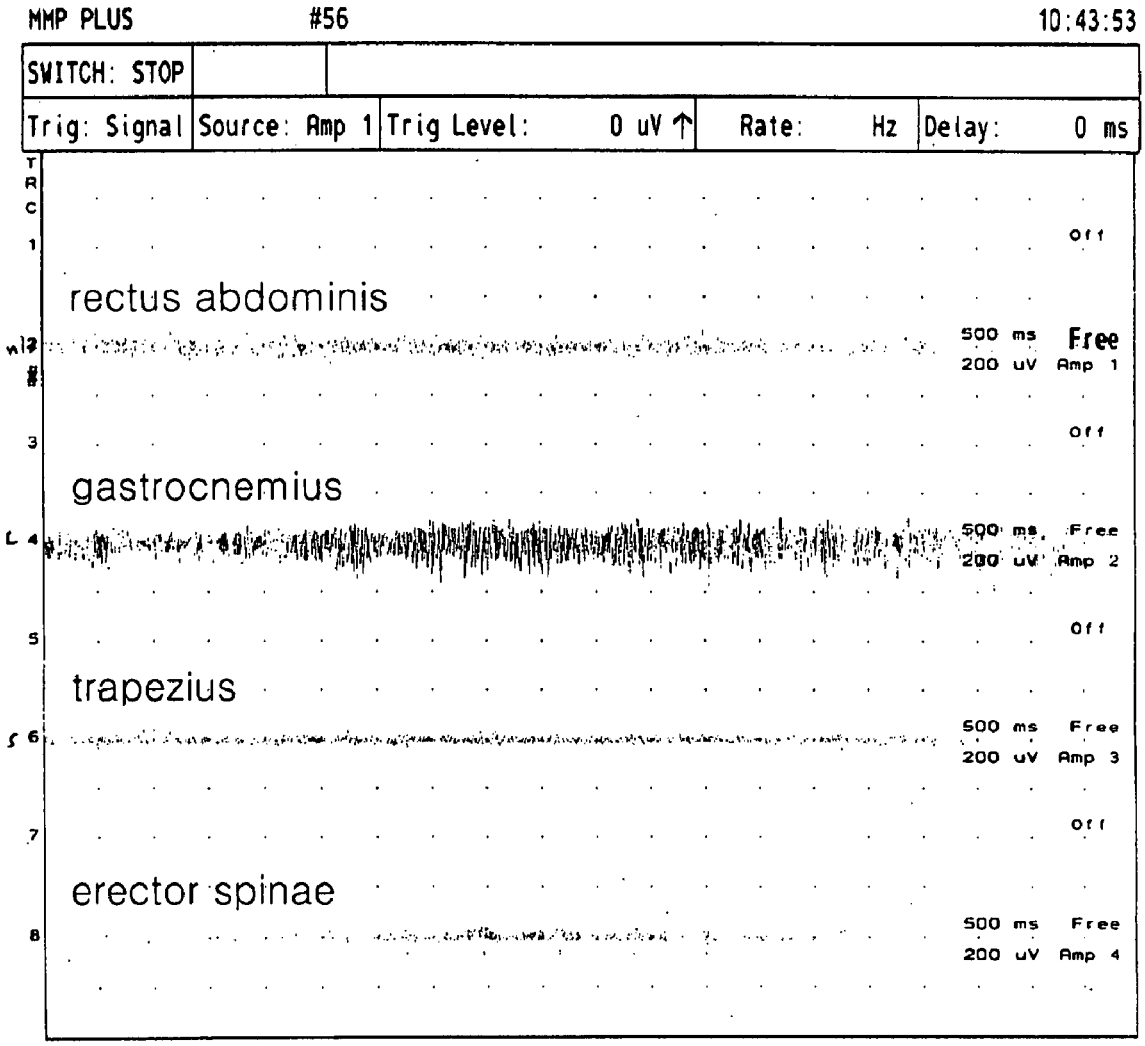
Figure 12:
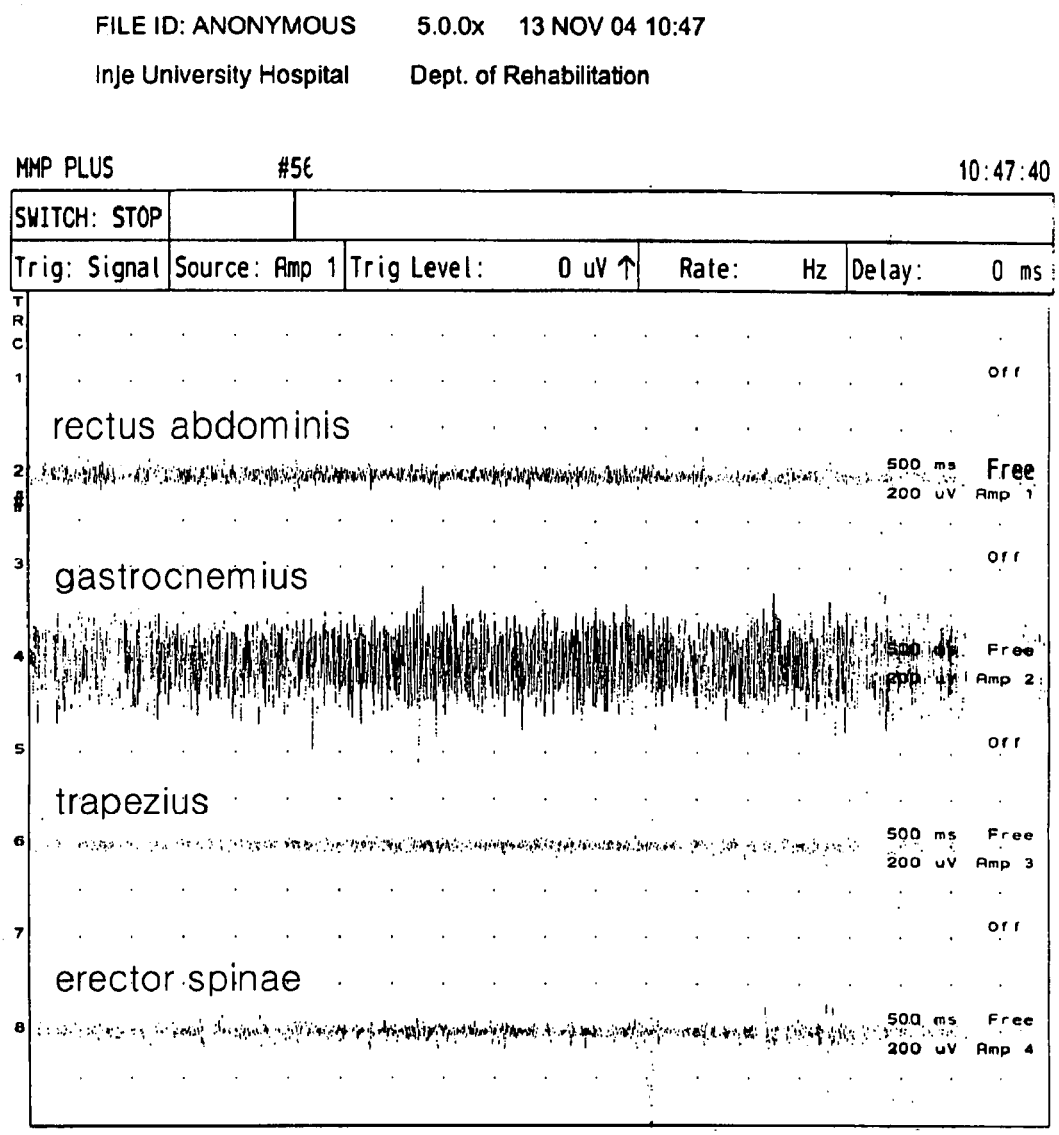
Figure 13:
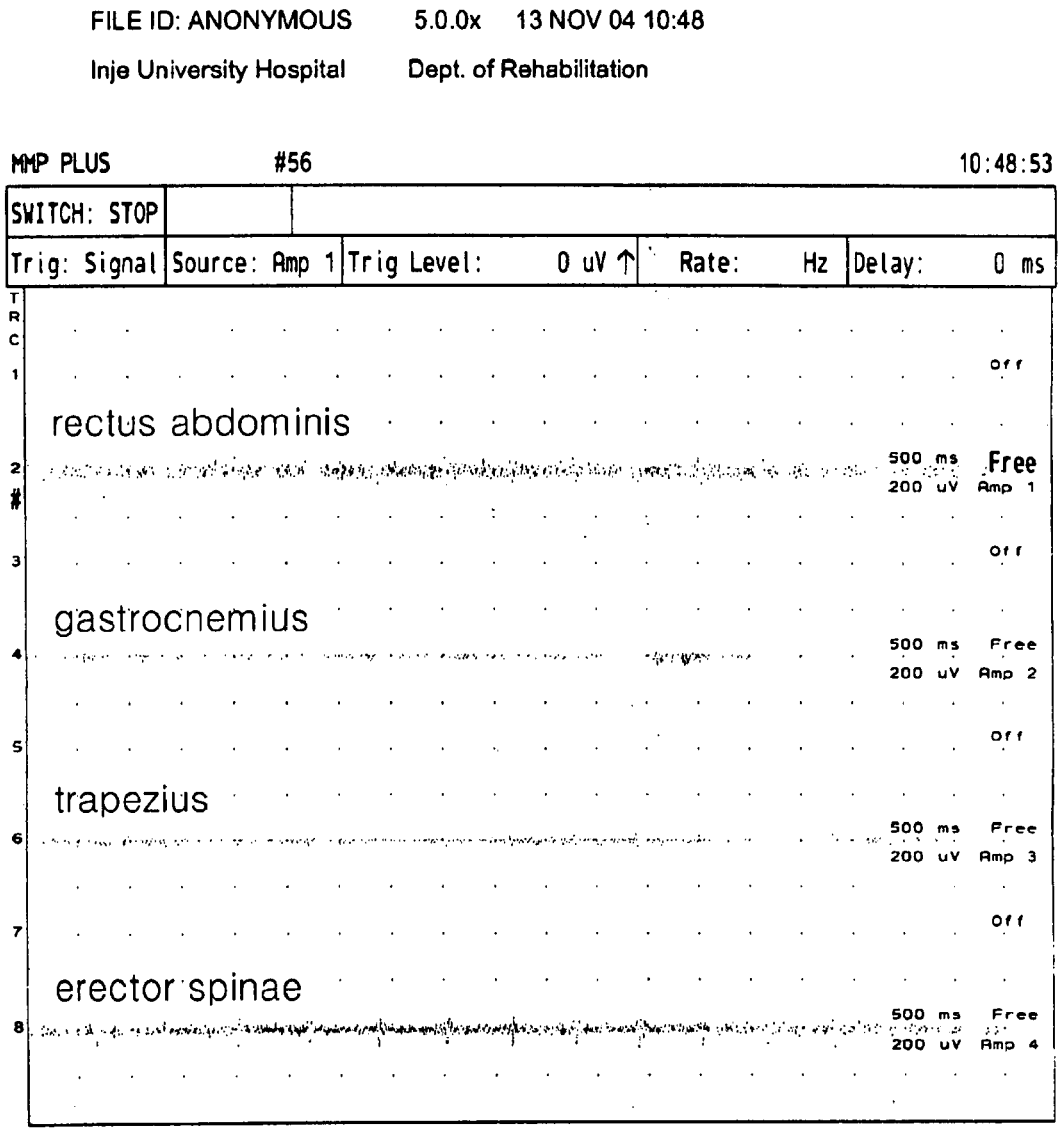
Figure 14:
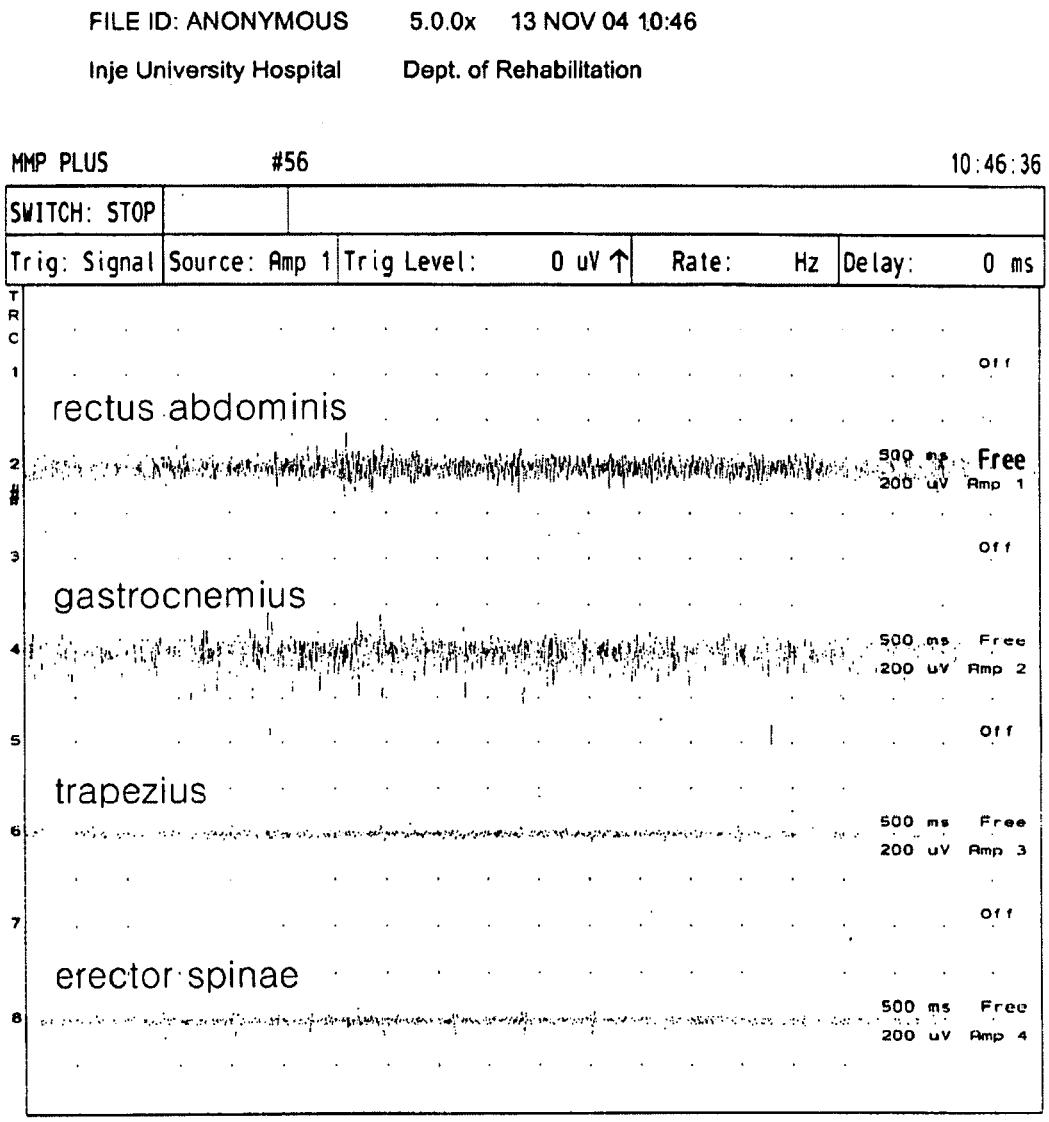

FIG. 7 and FIG. 11 are electromyograms in the case of walking barefoot, FIG. 8 and FIG. 12 are electromyograms in the case of wearing the ball-support-type diet shoes, FIG. 9 and FIG. 13 are electromyograms in the case of wearing the unstable ball-support-type diet shoes, and FIG. 10 and FIG. 14 are electromyograms in the case of wearing the rear balance walking shoes.

As described above, the electromyograms of the barefoot case are obtained when a walker's body stands and is in the most comfortable state. In these electromyograms, it is found that almost none of the muscles, except for the gastrocnemius, are moved.

In the case of wearing the ball-support-type shoes, since the heel is elevated, the gastrocnemius is highly taut. Further it is found that the tibialis anterior and peroneus longus move a large amount. Accordingly, we can see that the ankles move a large amount due to the instability of the shoes.

In the case of wearing the unstable ball-support-type shoes, even though toe sides of the feet are elevated but the wearer's body is quite stable, almost none the muscles move a large amount, but the peroneus longus are contracted.

In the case of wearing the rear balance walking shoes according to the present invention, since the toe sides are elevated and the wearer's body is slightly unstable, the tibialis anterior moves a large amount, and inversion of the foot is caused. Further, it is observed that foot eversion is caused little by little, viewed from the movement of the peroneus longus. The wearer's body is unstable in the backward direction, and the erector spinae and rectus abdominis move a large amount. Further, it is assumed that strength is not thrown through the shoulders from the observation that the trapezius hardly moves.

The above description is shown in table 1.

TABLE 1

| | Tiabialis anterior | Gastrocnemius | Peroneus longus | Erector spinae | Rectus abdominis | Trapezius |
|---|---|---|---|---|---|---|
| Barefoot | Almost no movement | Slight movement | Almost no movement | Almost no movement | Almost no movement | Almost no movement |
| Ball-support-type | Large walking stride, Large movement | Large movement | Slightly large walking stride, Large movement | Slight movement | Slight movement, Small walking stride | Almost no movement |
| Unstable ball-support-type | Uniform and large movement | Almost no movement | Almost no movement | Slight movement | Similar to the barefoot case | Almost no movement |
| Rear balance walking shoe | The largest movement, The largest walking stride | Similar to the barefoot case | Slight movement, Small walking stride | Large movement | The largest movement, The largest walking stride | Almost no movement |

Accordingly, if a walker walks in a natural walking posture, wearing the rear balance walking shoes according to the present invention, the tibialis anterior and peroneus longus move a large amount, so that the tibialis anterior and peroneus longus are strengthened, musculoskeletal system problems frequently caused in the ankles and knees are prevented, and vertebrae lumbales in which the muscles and nerves are connected are positively affected.

Further, since there is almost no tension of the gastrocnemius, and the muscles of the fibula are not strengthened, the rear balance walking shoes are helpful for the beauty of the calves. Still further, since the rectus abdominis are continuously taut, abdomen obesity problems are solved.

Figure 5:
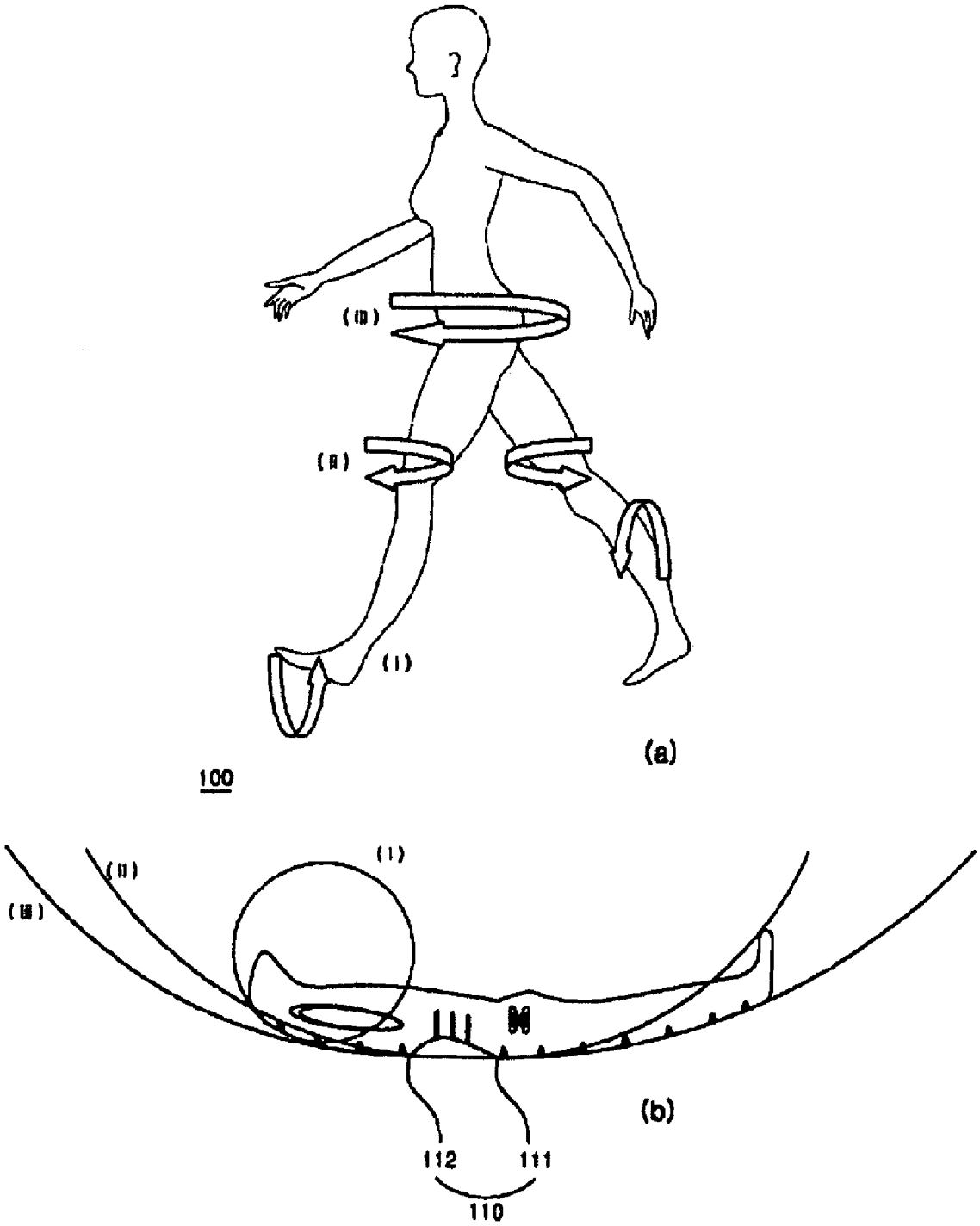
FIG. 5 illustrates pivots of joints of a body during a walking stride and curvatures of a sole of the rear balance of the walking shoe according to the present invention, in which (i) is an ankle, (ii) is a knee, and (iii) is a thigh.

Still further, as shown in FIG. 5(*a*), if a walker walks naturally with correct posture, joints of the walker's body pivot. FIG. 5(*b*) illustrates the curvature of the sole 100 of the rear balance walking shoe, in which the curvature of the sole 100 is designed considering the pivot curvatures of joints ((i) ankle, (ii) knee and (iii) thigh).

When a walker extends a leg forward and touches the earth with the sole of the shoe for walking while a walker wears the rear balance walking shoes according to the present invention, each part of the walker's body is smoothly pivoted, so that damage is not caused to joints which are parts for connecting bones.

Further, if a walker naturally walks with correct posture, the surface of the earth and the sole of the foot touch each other in the order of the heel, outer edges of the middle portion of the foot, and the big toe. At this time, since an inner portion of the sole 100 of the shoe is formed to be thinner than outer portions, the walker can walk with correct posture.

INDUSTRIAL APPLICABILITY

As described above, since the rear balance walking shoe according to the present invention has an obesity prevention effect, the shoes can be applied to a variety of fields. Particularly, when it is applied to sneakers, it can be used as a functional exercise shoe, thereby being capable of improving public health. Accordingly, the present invention has high industrial applicability.

Further, since the present invention also can be applied to footwear such as golf shoes, the present invention has wide and high applicability.

What is claimed is:

1. A rear balance walking shoe, comprising a sole in which two ground-contact protrusions are formed on the sole at a rear side with respect to the middle point of the sole to provide a rear balancing effect as a wearer stands while wearing the shoe, and a heel portion and a toe portion of the sole are elevated in curvature from the respective ground-contact protrusion to perform see-saw motions with the ground-contact protrusions serving as application points thereof, wherein the two ground-contact protrusions comprises a first ground-contact protrusion positioned at a region between a point of 50% and a point of 55% of the sole measured from the front end of the sole, and a second ground-contact protrusion positioned at a region between a point of 65% and a point of 75% of the sole measured from the front end of the sole, wherein a middle portion of the sole at regions immediately beside the ground-contact protrusions, a rear portion of the sole at rear side from the middle portion, and a front portion of the sole at front side from the middle portion each defines a respective surface curvature with its radius of curvature different from one another to accommodate a rolling support of the shoe as the wearer walks while wearing the shoe.

2. The rear balance walking shoe as claimed in claim 1, wherein the surface curvatures of the rear portion, the middle portion and the front portion of the sole are to accommodate curvatures of motions of an ankle, a knee and a thigh.

3. The rear balance walking shoe as claimed in claim 2, wherein the radius of curvature of the rear portion of the sole is about 80 to 100 mm, the radius of curvature of the middle portion of the sole is about 90 to 110 mm, and the radius of curvature of the front portion of the sole is about 400 to 500 mm.

4. The rear balance walking shoe as claimed in claim 1, further comprising a rigid auxiliary sole disposed on the sole.

5. The rear balance walking shoe as claimed in claim 4, wherein the rigid auxiliary sole has a flexible strength in the range of 70 to 120 kgf.

6. The rear balance walking shoe as claimed in claim 3, wherein a medial side of the sole is thinner than a lateral side of the sole

.

* * * * *